United States Patent [19]

Yamaguchi et al.

[11] 4,049,212

[45] Sept. 20, 1977

[54] APPARATUS FOR INDEPENDENTLY REWINDING SLIT STRIPS IN A WEB SLITTING AND REWINDING MACHINE

[75] Inventors: Toshiaki Yamaguchi; Jinichi Shoji, both of Kyoto, Japan

[73] Assignee: Nishimura Seisakusho Co., Ltd., Kyoto, Japan

[21] Appl. No.: 706,781

[22] Filed: July 19, 1976

[30] Foreign Application Priority Data

July 21, 1975 Japan ..... 50-89952

[51] Int. Cl.[2] ..... B65H 19/04; B65H 17/08

[52] U.S. Cl. ..... 242/56.9; 242/65

[58] Field of Search ..... 242/56.9, 56.2, 56.3, 242/56.6, 56.7, 65, 75.2, 67.5

[56] References Cited

U.S. PATENT DOCUMENTS

| | | | |
|---|---|---|---|
| 2,581,242 | 1/1952 | Dickhaut | 242/65 |
| 3,122,335 | 2/1964 | Dusenbery | 242/56.2 |
| 3,222,004 | 12/1965 | Crowe | 242/56.9 |
| 3,949,948 | 4/1976 | Tomma | 242/56.9 |

*Primary Examiner*—Edward J. McCarthy
*Attorney, Agent, or Firm*—Amster & Rothstein

[57] ABSTRACT

An apparatus for independently and simultaneously rewinding a plurality of slit strips into rolls is provided for a slitting and rewinding machine. The apparatus includes a single elongated contact roller and a plurality of rewinding cores. The rewinding cores are arranged side by side in at least one row parallel to the axis of the contact roller. Each rewinding core is independently supported for rotation by at least one vertically extending support arm. The support arms for the rewinding cores are in turn pivotally connected to a common support base which is adapted to be positively retracted horizontally away from the contact roller. During rewinding operation, as the diameter of strip rolls wound onto the rewinding core increases, the core support arms are moved angularly from their vertical position. The angular displacement of at least one core support arm is detected to automatically control the retractive movement of the support base in relation to the increasing roll diameter such that the core support arms are kept substantially in their vertical position while maintaining the wound rolls on the cores in constant engagement with the contact roller throughout a rewinding cycle regardless of a change in the diameter of each wound roll.

8 Claims, 2 Drawing Figures

APPARATUS FOR INDEPENDENTLY REWINDING SLIT STRIPS IN A WEB SLITTING AND REWINDING MACHINE

BACKGROUND OF THE INVENTION

This invention generally relates to apparatus for rewinding flexible web material. In particular, this invention relates to apparatus for independently rewinding a plurality of slit web material into rolls in a web slitting and rewinding machine.

In a web slitting machine, a flexible web material is slit into a plurality of continuous strips and such strips are wound into rolls by a strip rewinding apparatus. In order to wind continuous strips of thin web material of a poor tensile strength with slippery surfaces into soft rolls of a substantially uniform density and with smooth end faces, it is necessary to have a roller in peripheral contact with the strip roll being wound and keep the pressure between the contact roller and the strip roll substantially at a predetermined constant level throughout a rewinding cycle. Still better results are obtained if the strips are rolled up by employing not only centre driving but also surface driving. In the web slitting machine, a continuous web is generally slit into a plurality of strips and these strips are wound simultaneously into different rolls by a winding apparatus. Various winding apparatus are known and used in the web slitting machines to wind simultaneously a plurality of slit strips into rolls. However, prior winding apparatus are complicated in structure, bulky in size and are not necessarily satisfactory in operation. For example, in prior winding apparatus, a plurality of rewinding cores are supported by a common support structure, and accordingly it is impossible to regulate various rewinding conditions of each strip roll independently of other strip rolls.

SUMMARY OF THE INVENTION

Accordingly, it is an object of the invention to provide an improved apparatus for independently rewinding a plurality of flexible web material into rolls.

It is a further object of the invention to provide an apparatus adapted to be used in a slitting machine for rewinding independently a plurality of flexible slit strips onto rewinding cores which are supported independently of each other.

It is another object of the invention to provide the above described apparatus which are simple in structure and less bulky in size.

Briefly stated, according to the invention, there is provided an apparatus for simultaneously and independently rewinding a plurality of slit strips of flexible web material into rolls. The apparatus comprises a single contact roller rotatably supported at a fixed position and a plurality of rewinding cores arranged side by side in a row generally parallel to the axis of the contact roller. Each rewinding core is rotatably supported by a separate and independent pair of support arms which are pivotally connected to a common support base or block. The core support arms are held normally in substantially vertical position but are angularly movable about the pivot points to and fro from their vertical position within a limited range of angle. While on the other hand, the single support block on which all of the core support arms are pivotally mounted is adapted to be driven horizontally away from the fixed contact roller by suitable drive means during rewinding operation. In operation, a flexible web of material is slit into a plurality of narrower strips in a slitting machine and the slit strips are led around the contact roller onto the rewinding cores in the rewinding apparatus. At the outlet of the rewinding cycle of operation, the support block is placed at such a position as to hold the core support arms in engagement with the contact roller. Pressure applying means connected to the support arms urges the rewinding core into engagement with the contact roller at a predetermined pressure. Upon initiation of the rewinding cycle, the slit strips are wound into rolls on respective rewinding cores by rotatably driving the rewinding core and/or the contact roller. As the slit strips are wound onto the cores to form rolls of strips, the diameter of the wound rolls gradually increases and, as the roll diameter increases, the core support arms are urged angularly from the vertical position in a direction away from the contact roller. The angular displacement of at least one support arm is sensed by detecting means which produces and supplies a signal proportional to the displacement of the support arm to means for controlling the support block driving means. The control means controls the drive means in response to the input signal such that the support block carrying the rewinding cores are moved horizontally away from the fixed contact roller according as the roll diameter increases. The core support arms are subsequently held back toward their vertical position. If the retractive movement of the support block away from the fixed contact roller exceeds an increase of the roll diameter, then the core support arms move angularly from the vertical position in a direction toward to the contact roller. This angular displacement is also sensed by the detecting means which controls the support block drive means in such a manner as to slow down the retractive movement of the support block. As a result, the support arms are again urged back into their vertical position. In this way, the retraction of the support block is automatically and positively controlled in response to the angular displacement of the core support arms from the vertical position such that the support arms are moved simultaneously away from the contact roller according as the diameter of the strip rolls are increased thereby keeping the strip rolls in peripheral engagement with the contact roller on one hand and keeping the roll support arms generally in their vertical position throughout the winding cycle.

According further to the invention, means is provided to compensate for a change in the contact pressure between each wound roll and the contact roller from the predetermined level which occurs when the roll support arms moves angularly from the vertical position. In addition, means is provided to prevent or absorb "hunting" or oscillation of each of the wound rolls of strips.

DETAILED DESCRIPTION OF THE PREFERRED EMBODIMENT

Figure 2:
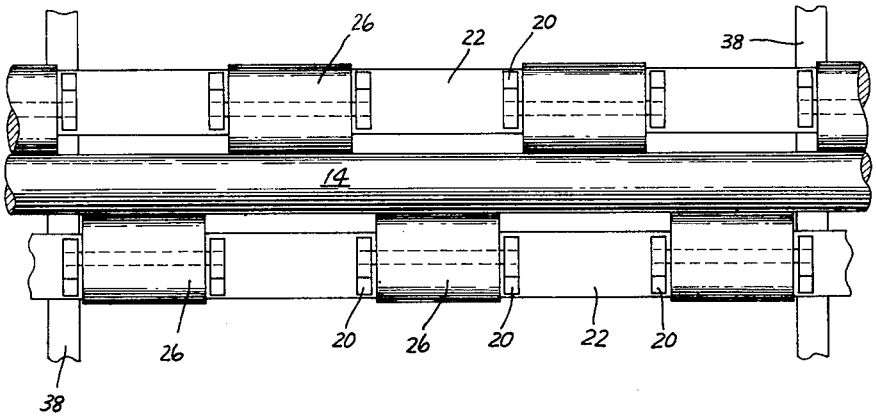
FIG. 2 is a partial plan view of the rewinding apparatus shown in FIG. 1 with some component parts being omitted for the simplification of the drawing.

Referring now to the drawings, there is illustrated an apparatus for independently rewinding a plurality of continuous strips into rolls in a web slitting machine. In a typical web slitting machine, thin web material is taken out from a source to be cut into a plurality of continuous strips at a slitting section. The slit strips 10 from the slitting section are led over a guide roller 12 and a contact roller 14 into the rewinding apparatus generally indicated by a reference numeral 16. In the illustrated embodiment, the contact roller 14 is horizontally supported for rotation at a fixed position and a plurality of rewinding cores 18 are arranged generally parallel to the axis of the contact roller 14 in two rows on opposite sides of the contact roller. As is apparent from FIG. 2, the rewinding cores in one row are positioned in an alternating relation with respect to the rewinding cores in the other row. Since the rewinding cores in the upper row with their associated support mechanism are substantially identical in both structure and function with the rewinding cores in the lower row, only the lower row of rewinding cores will be explained below.

According to the invention, each rewinding core 18 is rotatably supported by a separate and independent pair of substantially vertically extending support arms 20 between the upper ends of the support arms. The plurality of rewinding cores thus supported are arranged side by side generally in parallel to the axis of the contact roller 14 as described above. In order to roll up the slitted strips, the rewinding cores 18 are rotated by their respective drive means (not shown) and/or they may be surface-driven by the common contact roller 14 which in turn is positively rotated by a suitable driving source (not shown).

The support arms 20 for the rewinding cores 18 are connected to a single support block or base 22 by a pivot shaft 24 for a limited angular movement from their vertical position about the pivot shaft. It is noted that the support block 22 and the pivot shaft 24 are common throughout the core support arms 20 and extend along the entire length of the row of rewinding cores.

For a smooth and efficient rewinding of the slitted strips, rolls 26 of strip being wound on the cores must be respectively kept in substantially constant pressure engagement with the contact roller 14 during operation. For the purpose, pressure applying means in the form of a pneumatic cylinder 28 is mechanically connected between the support block 22 and at least one of support arms 20 in each pair. When actuated, the rod of the pneumatic cylinder 28 extends outward to move the support arm 20 in clockwise direction about the pivot shaft 24 thereby urging and keeping the roll 26 in pressure engagement with the contact roller 14. The pressure under which the roll is kept in contact with the roller 14 may be varied by adjusting the driving force of the pneumatic cylinder 28. Other pressure applying means such as coil springs and diaphragm operated devices may suitably be used in lieu of the illustrated pneumatic cylinder.

With the vertically extending core support arms 20 being mounted to allow a limited angular displacement from their vertical position for the purpose described below, the diameter of the wound strip rolls 26 gradually increases as the rewinding operation proceeds. As the roll diameter increases, the roll support arms 20 are urged counterclockwise about the pivot shaft 24 since the contact roller 14 is held rotatably at a fixed position. At the initial stage of the counterclockwise angular displacement of the support arms from the vertical position, the pressure between the strip roll 26 and the contact roller 14 tends to increase over the predetermined level as set by the pneumatic cylinder 28. As such angular displacement becomes greater, i.e., the support arms are moved in counterclockwise direction further away from the vertical position, the weight of the strip roll being wound on the core and the support arms for the core acts to increase the angular displacement within the allowable range thereby urging the strip roll away from the contact roller. The result is a decrease of the peripheral contact pressure between the strip roll and the contact roller below the predetermined level. On the other hand, if the support arms 20 move in clockwise direction away from the vertical position, then the strip roll 26 is urged into a tighter pressure engagement with the contact roller thereby increasing the pressure of contact between the strip roll and the contact roller over the predetermined level. In short, the contact pressure between the strip roll and the contact roller varies or deviates from the predetermined level as the strip roll supporting arms move angularly from the vertical position within the limited angle due to a changing moment of rotation of the support arms. In order to compensate for such pressure change and keep the contact pressure substantially constant at the predetermined level, means for compensating the contact pressure change is provided according to the invention. In the illustrated embodiment, the pressure compensating means comprises a pair of coil springs **30*a* and 30*b* interposed in compression between each support arm 20 and the support block 22 on opposite sides of the pivot shaft 24**. It is understood that so long as the displacement of the support arms from their vertical position is within a small angle, the moment of rotation of the support arms varies substantially linearly with the angle of displacement. Thus, a variation of the contact pressure due to the changing moment of rotation of the support arms is effectively compensated by the coil springs having a linear resiliency characteristic. Although a pair of coil springs are employed in the illustrated embodiment, the same pressure compensating function may be performed by connecting only a single coil spring between each support arm and the support block instead of merely interposing therebetween.

Since the support arms 20 are mounted on the support block 22 for a limited angular movement about the pivot shaft 24 from their vertical position, there is also a good possibility that the support arms may cause hunting i.e., oscillate to and fro from the vertical position during rewinding operation. In order to eliminate this undesirable hunting as much as possible, there is provided between each support arm 20 and the support block 22 oscillation suppressor means in the form of a hydraulic damper 32.

According to an important aspect of the invention, the support block 22 for the plurality of the roll support arms 20 is adapted to be horizontally driven away from the contact roller 14 and the retractive movement of the support block is automatically controlled in relation to the increasing roll diameter during the rewinding operation. As shown, the support block 22 is fixedly mounted on a beam 34 which in turn is supported on a slide block 36. The slide block is slidable along one or more horizontal guide rails 38 extending generally perpendicular to the axis of the contact roller 14 and is adapted to be driven by a suitable drive means such as a hydraulic or electric motor M (shown as "MOTOR" in FIG. 1). As discussed above, the diameter of the strip rolls gradually increases with the progress of rewinding operation and an increase in the roll diameter causes the associated support arms to move in counterclockwise direction away from the vertical position about the pivot shaft within the limited permissible angular range. According to the invention, the angular displacement of each pair or one representative pair of support arms 20 is detected to control the retractive movement of the slide block such that the support arms are moved away from the contact roller in proportion to the increasing diameter of the wound strip rolls thereby keeping the strip rolls in constant peripheral engagement with the contact roller while maintaining the support arms substantially in their vertical position throughout the rewinding cycle.

Figure 1:
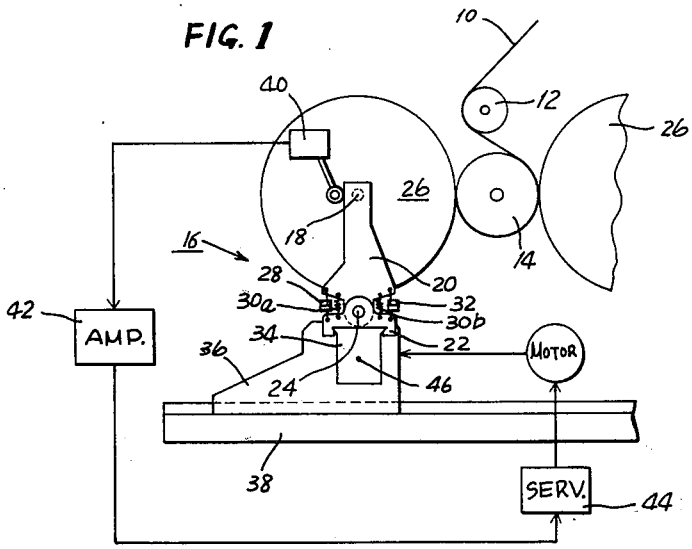
FIG. 1 is a side view of a slit strip rewinding apparatus embodying the invention.

More specifically, as shown in FIG. 1, in order to detect the angular displacement of the support arms, there is provided position detecting means 40 such as a nozzle flapper and a differential transformer with respect to at least one support arm in each pair of support arms. The position detector 40 produces a signal proportional to the amount of the angular displacement of the support arm. The output signal from the position detector is amplified by an amplifier 42 and fed to a servo-control 44 such as a servomotor and servo-valve. The servo-control 44 performs control over the drive motor M for the slide block 36 in response to the amplified command signal from the amplifier 42. With this arrangement, as the support arms 20 are moved counterclockwise from their vertical position by the strip rolls of increasing diameter, the counterclockwise displacement is sensed by the position detector 40 which provides a command signal proportional to the amount of the displacement to the servo-control 44 via the amplifier 42. The servo-control in turn controls the drive motor M in response to the command signal such that the drive motor may move the slide block 36 along the guide rails 38 away from the contact roller 14 in relation to the increasing roll diameter. If the retraction of the slide block exceeds the increase of the roll diameter, then the support arms are inclined toward the contact roller i.e., the arms are moved angularly from their vertical position in clockwise direction. The clockwise rotation of the support arms are also sensed by the detector 40 to control the drive motor M so that the retraction of the slide block 36 is slowed down permitting the support arms back to their vertical position and keeping the strip rolls in predetermined normal engagement with the pressure roller. In this connection, it is pointed out that pairs of support arms are mounted to the common support block for supporting a plurality of strip rolls, each pair having at least one position detector associated therewith, and that the roll diameter of the strip rolls, thus the angular displacement of their associated support arms at any selected time in the rewinding process may vary slightly from roll to roll due to different rewinding conditions. In controlling the drive motor in response to the angular displacement of the support arms, position indicating signals from the plurality of the detectors may first be supplied to a suitable arithmetic unit (not shown) to provide an average position signal and then this average signal may be fed to the amplifier to be ultimately used to control the drive motor. Or alternatively, the angular displacement of only one pair of the support arms for a strip roll may be detected as representative of the remaining pairs and used to automatically control the retractive movement of the slide block in relation to the increasing roll diameter as explained above. In this manner, the slide block 36 is automatically and positively driven by the motor away M from the contact roller 14 according to the increase of the strip rolls 26 so as to keep the support arms in their substantially vertical position on one hand and to maintain the wound strip rolls in constant engagement with the contact roller throughout the rewinding cycle.

When the slitted strips are rewound into rolls of the predetermined diameter, the mounting beam 34 is rotated counterclockwise about an axle 46 until the support arms 20 are brought down to generally horizontal position. Thereafter the completed rolls 26 of slitted strips are removed from their respective support arms 20.

As described above, in the rewinding apparatus of the invention, a plurality of slit strips are simultaneously and independently wound into separate rolls with each strip roll kept in peripheral contact with a single contact roller substantially at a predetermined pressure throughout the rewinding cycle. While the contact roller is supported at a fixed position, each rewinding core is supported on a separate and independent pair of vertically extending support arms. The support arms are in turn pivotally connected to the support block for angular movement to and fro from the vertical position within a limited angle. With the arrangement, as the diameter of each strip roll increases with the progress of the rewinding operation, the support arms are moved angularly about the pivot axle from their vertical position. The angular displacement of one representative pair of the support arms or the average angular displacement of all pairs of the support arms is detected and used to automatically and positively control the retractive movement of the mounting block in such a manner as to maintain all of the support arms in substantially their vertical position while keeping the wound rolls of strip in constant engagement with the contact roller throughout the rewinding cycle regardless of the increasing roll diameter. In prior apparatus, roll support arms are not maintained in vertical position during the winding cycle but must be rotated through a great angular distance, for example, over 90° according as the diameter of the strip rolls increases. This made it necessary to equip the rewinding apparatus with longer roll support arms, which in turn made the apparatus bulky in size. On the contrary, in the apparatus of the invention the roll support arms are kept substantially in their vertical position during the rewinding cycle. Accordingly, there is no need to have long support arms as in the prior apparatus. Support arms having a length approximately equal to the desired maximum roll diameter are sufficient for the purpose. With shorter support arms, the overall size of the apparatus is correspondingly reduced. The horizontal retraction of the vertically held roll support arms during the rewinding process together with the provision of the contact pressure compensating springs is effective to keep the pressure between the contact roller and the strip rolls substantially at a predetermined constant level throughout the rewinding cycle. This in turn is of great service to provide wound rolls of a high quality. Further, as an important feature of the invention, while the support arms for rotatably supporting a plurality of strip rolls are mounted on the common base for movement in unison away from the contact roller, each strip roll is supported independently by its associated support arms. Accordingly, it is possible to individually adjust and control various parameters effecting the rewinding operation of each strip roll depending on given rewinding conditions. Also, since each pair of support arms is independently movable about the pivot shaft within the limited angular distance, strip rolls supported by the arms are kept in constant engagement with the contact roller at their desired predetermined pressure even if there is a slight difference in diameter between rolls.

While there has been shown and described only one preferred embodiment of the invention, various changes and modifications may be made by one skilled in the art within the sprit and scope of the invention.

What is claimed is:

1. Apparatus for independently rewinding a plurality of slit strips in a web slitting and rewinding machine comprising:

a contact roller supported for rotation at a fixed position:

a plurality of slit strip rewinding cores arranged generally parallel to the axis of said contact roller at least in one row for contact with said contact roller;

a plurality of support means for rotatably supporting said rewinding cores, respectively;

a common support base for said plurality of support means, said common support base pivotally carrying said support means to allow said support means to swing for a limited angular range;

means for detecting any angular displacement of at least one of said support means to provide control signals; and drive means for moving said common support base in response to said control signals in such a manner that said slit strip rewinding cores may be moved away from said contact roller according as the diameter of each of the rewound rolls on said rewinding cores is increased, each of said rewound rolls being kept in contact with said contact roller.

2. Apparatus as defined in claim 1, in which each of said support means comprises a pair of vertically extending arms having one set of ends for rotatably supporting said rewinding cores and having other ends to be pivotally connected to said common support base by a pivot axle.

3. Apparatus as defined in claim 1 further including means for compensating any change in the contact pressure between said contact roller and each of said rewound rolls due to a displacement of said support means.

4. Apparatus as defined in claim 3 in which said means for compensating a change in the contact pressure comprises spring means.

5. Apparatus as defined in claim 4 which said spring means comprises a pair of springs interposed between said support means and said common support base on the opposite sides said pivot axle connecting said support means to said common support base.

6. Apparatus as defined in claim 4 in which said spring means is fixed at its opposed ends to said support means and said common support base, respectively.

7. Apparatus as defined in claim 1 further including means for positively urging said rewound roll on each of said rewinding cores toward said contact roller.

8. Apparatus as defined in claim 7 further including means for preventing vibration of said support means.

* * * * *